US012629794B2

(12) United States Patent
Shi et al.

(10) Patent No.: US 12,629,794 B2
(45) Date of Patent: May 19, 2026

(54) SPIRAL MAGNETORHEOLOGICAL POLISHING METHOD FOR MID-SPATIAL-FREQUENCY ERROR CONTROL

(71) Applicant: NATIONAL UNIVERSITY OF DEFENSE TECHNOLOGY, Changsha (CN)

(72) Inventors: Feng Shi, Changsha (CN); Bo Wang, Changsha (CN); Ci Song, Changsha (CN); Guipeng Tie, Changsha (CN); Xing Peng, Changsha (CN); Shuo Qiao, Changsha (CN); Baoqi Gong, Changsha (CN)

(73) Assignee: NATIONAL UNIVERSITY OF DEFENSE TECHNOLOGY, Changsha (CN)

( * ) Notice: Subject to any disclaimer, the term of this patent is extended or adjusted under 35 U.S.C. 154(b) by 0 days.

(21) Appl. No.: 19/071,899

(22) Filed: Mar. 6, 2025

(65) Prior Publication Data

US 2025/0387873 A1 Dec. 25, 2025

(30) Foreign Application Priority Data

Jun. 20, 2024 (CN) ..... 202410798134.6

(51) Int. Cl.
*B24B 49/02* (2006.01)
*B24B 1/00* (2006.01)
(Continued)

(52) U.S. Cl.
CPC ..... *B24B 49/02* (2013.01); *B24B 13/012* (2013.01); *B24B 31/112* (2013.01); *B24B 49/12* (2013.01); *B24B 51/00* (2013.01); *B24B 1/005* (2013.01)

(58) Field of Classification Search
CPC ..... B24B 1/005; B24B 31/112; B24B 49/10
(Continued)

(56) References Cited

U.S. PATENT DOCUMENTS 5,795,212 A * 8/1998 Jacobs ..... H01F 1/447 451/36
2005/0202754 A1* 9/2005 Bechtold ..... B24B 13/01 451/5

(Continued)

FOREIGN PATENT DOCUMENTS

CN 116394113 A 7/2023

OTHER PUBLICATIONS

Chris Supranowitz, Andrew Jones, "Magnetorheological finishing of freeform optics using a spiral toolpath," Proc. SPIE 11889, Optifab 2021, 118891B (Oct. 28, 2021); https://doi.org/10.1117/12.2602831 (Year: 2021).*

(Continued)

*Primary Examiner* — Makena S Markman
(74) *Attorney, Agent, or Firm* — Thomas | Horsetemeyer, LLP

(57) ABSTRACT

A spiral magnetorheological polishing method for mid-frequency error control is provided, relating to the technical field of optical polishing. The method includes: scanning along a polishing path by using a magnetorheological polishing method, and removing a material in a spiral manner with a polishing tool to achieve spiral magnetorheological polishing of a workpiece. An angle between a scanning direction and a workpiece material removal direction is changed in real time during scanning, to alter a spatial posture of a removal function on a polishing surface in a spiral manner, thereby reducing mid-frequency errors. The method further includes: during scanning, randomly changing a processing line spacing in real time to further achieve (Continued)

suppression of mid-frequency ripple errors. A scanning strategy employs raster scanning processing; when the scanning strategy employs raster scanning processing, the processing line spacing is a raster scanning spacing.

12 Claims, 6 Drawing Sheets

(51) Int. Cl.
*B24B 13/01* (2006.01)
*B24B 31/112* (2006.01)
*B24B 49/12* (2006.01)
*B24B 51/00* (2006.01)

(58) Field of Classification Search
USPC ..... 451/113, 36, 5
See application file for complete search history.

(56) References Cited

U.S. PATENT DOCUMENTS

2022/0118577 A1* 4/2022 Wei ..... B24B 1/005
2022/0314390 A1* 10/2022 Messner ..... B24B 13/01

OTHER PUBLICATIONS

First Office Action for Application No. 202410798134.6 dated Jul. 25, 2024 with translation.

* cited by examiner

SPIRAL MAGNETORHEOLOGICAL POLISHING METHOD FOR MID-SPATIAL-FREQUENCY ERROR CONTROL

CROSS REFERENCE TO RELATED APPLICATION

This patent application claims the benefit and priority of Chinese Patent Application No. 202410798134.6, filed with the China National Intellectual Property Administration on Jun. 20, 2024, the disclosure of which is incorporated by reference herein in its entirety as part of the present application.

TECHNICAL FIELD

The present disclosure relates to the technical field of optical polishing, and in particular, to a spiral magnetorheological polishing method for mid-spatial-frequency error control.

BACKGROUND

With the continuous advancement of optical systems, high-performance optical systems in various fields, such as high-energy laser systems, advanced optics, next-generation core components, and lithography systems, have imposed strict requirements on the full spatial frequency band errors of optical components.

Magnetorheological polishing uses small-sized polishing tools to "repair" surface shape errors of larger surfaces along specific polishing paths, achieving key advantages such as extremely high deterministic shaping capability, ultra-high surface quality, and subsurface damage-free characteristics, thereby ensuring the processing accuracy of components while maintaining high efficiency. It is an extremely important processing method in the field of optical manufacturing.

The scanning strategy for polishing paths generally employs a raster scanning path is employed, where variations in the dwell time of a polishing tool influence function at different dwell points along the path (the convolution of the tool influence function and the processing path) results in the removal of more material at "high points" and less material at "low points." However, discontinuous motion of this method introduces regular convolution residuals (a spatial error period is typically between 0.03 $mm^{-1}$ and 8 $mm^{-1}$), known as mid-frequency ripple errors. Mid-frequency ripple errors are a significant component of mid-spatial-frequency errors, and an increase in mid-spatial-frequency errors can lead to increased beam modulation, introduce small-angle scattering, reduce image contrast, and even cause nonlinear self-focusing, thus damaging optical components and severely compromising the performance of optical systems. Therefore, mid-frequency ripple errors have become the primary issue limiting the further development of sub-aperture polishing technology.

In the prior art, the control of mid-spatial-frequency errors in magnetorheological polishing processes can be broadly divided into two types: one uses pseudo-random paths for processing, and the other employs the magic angle-step method, which positions an angle between a polishing wheel and the path at a specific angle to suppress mid-spatial-frequency errors.

However, the former approach results in a complex path and imposes extremely strict requirements on the dynamic performance of the machine tool, potentially damaging the machine. In the latter approach, the material removal mechanism still relies on the convolution of the tool influence function and the polishing path, which still introduces mid-frequency ripple errors (convolution residuals).

SUMMARY

Based on this, it is necessary to provide a spiral magnetorheological polishing method for mid-spatial-frequency error control, to eliminate mid-frequency ripple errors from a mechanistic perspective. This is of significant importance for the development of the processing field.

A spiral magnetorheological polishing method for mid-spatial-frequency error control is provided, including:

scanning along a polishing path by using a magnetorheological polishing method, and removing a material in a spiral manner with a polishing tool to achieve spiral magnetorheological polishing of a workpiece;

where an angle between a scanning direction and a workpiece material removal direction is changed in real time during scanning, to alter a spatial posture of a tool influence function on a polishing surface in a spiral manner, thereby reducing mid-spatial-frequency errors.

In one embodiment, that an angle between a scanning direction and a workpiece material removal direction in real time during scanning includes:

at the start of scanning and each time a scan line changes, giving a random angle to the polishing tool, and changing the angle between the scanning direction and the workpiece material removal direction in real time.

In one embodiment, that a spatial posture of a tool influence function on a polishing surface is altered in a spiral manner includes:

altering the spatial posture of the tool influence function on the polishing surface in real time in a spiral manner with the polishing tool, so that one-dimensional profiles superimposed by the tool influence function each time on a cut line that is randomly selected on the polishing surface and perpendicular to a raster scanning path are all different.

In one embodiment, the random angle given to the polishing tool is within a preset range.

In one embodiment, the angle between the scanning direction and the workpiece material removal direction is changed in real time at a uniform speed.

In one embodiment, a material removal process includes:

$$R(x, y) = \sum_{i=1}^{n}\sum_{j=1}^{m} TIF(x, y, t_{ij}) \times T(x, y) \neq TIF(x, y) * L(x, y)$$

where R(x,y) is a total material removal amount of a spiral tool influence function on the polishing surface, i=1, 2, . . . , n is the number of processing points in the scanning direction, j=1, 2, . . . , m is the number of line changes in the scanning, $TIF(x,y,t_{ij})$ is a spiral time-varying tool influence function, T(x,y) is a dwell time of the polishing tool at each point on a trajectory, TIF(x,y) is a tool influence function per unit time, * denotes convolution, and L(x,y) is a path function combined with the dwell time.

In one embodiment, a frequency spectrum of a surface texture in a line change direction obtained after spiral magnetorheological polishing includes:

$$G(f)=\sum_{j=1}^{m}\frac{p_j}{a_j}\cdot F(f(a_j x))\cdot(\cos(2\pi f\cdot jd)-i'\sin(2\pi f\cdot jd))$$

where G(f) is the frequency spectrum of the surface texture in the line change direction after the spiral magnetorheological polishing is completed; i' is an imaginary unit; j=1, 2, . . . , m is the number of line changes in raster scanning; $p_j$ is an efficiency variation factor when the number of line changes is j; $a_j$ is a length variation factor when the number of line changes is j; when f=1/d, a real part of the frequency spectrum reaches a maximum value; $F(f(a_j x))$ is a frequency spectrum of one-dimensional profiles superimposed by the tool influence function; f is a corresponding frequency on the frequency spectrum of the one-dimensional profiles, and d is a processing line spacing.

In one embodiment, the method includes: during scanning, randomly changing a processing line spacing in real time to further achieve suppression of mid-frequency ripple errors.

In one embodiment, a scanning strategy employs raster scanning processing.

In one embodiment, when the scanning strategy employs raster scanning processing, the processing line spacing is a raster scanning spacing.

The foregoing spiral magnetorheological polishing method for mid-spatial-frequency error control overcomes the shortcomings of existing magnetorheological polishing methods, that is, mid-frequency ripple errors are produced easily, leading to a significant increase in mid-spatial-frequency errors. By using a controllable spiral tool influence function, it reduces mid-spatial-frequency errors, especially mid-frequency ripple errors. A random line spacing is set, that is, a random-line-spacing magnetorheological polishing method is designed, complementing the controllable spiral tool influence function. In other words, the spiral magnetorheological polishing method is combined with the random-line-spacing magnetorheological polishing method, achieving the mechanistic elimination of mid-frequency ripple errors, thereby reducing mid-spatial-frequency errors on the surface.

DETAILED DESCRIPTION OF THE EMBODIMENTS

Figure 1:
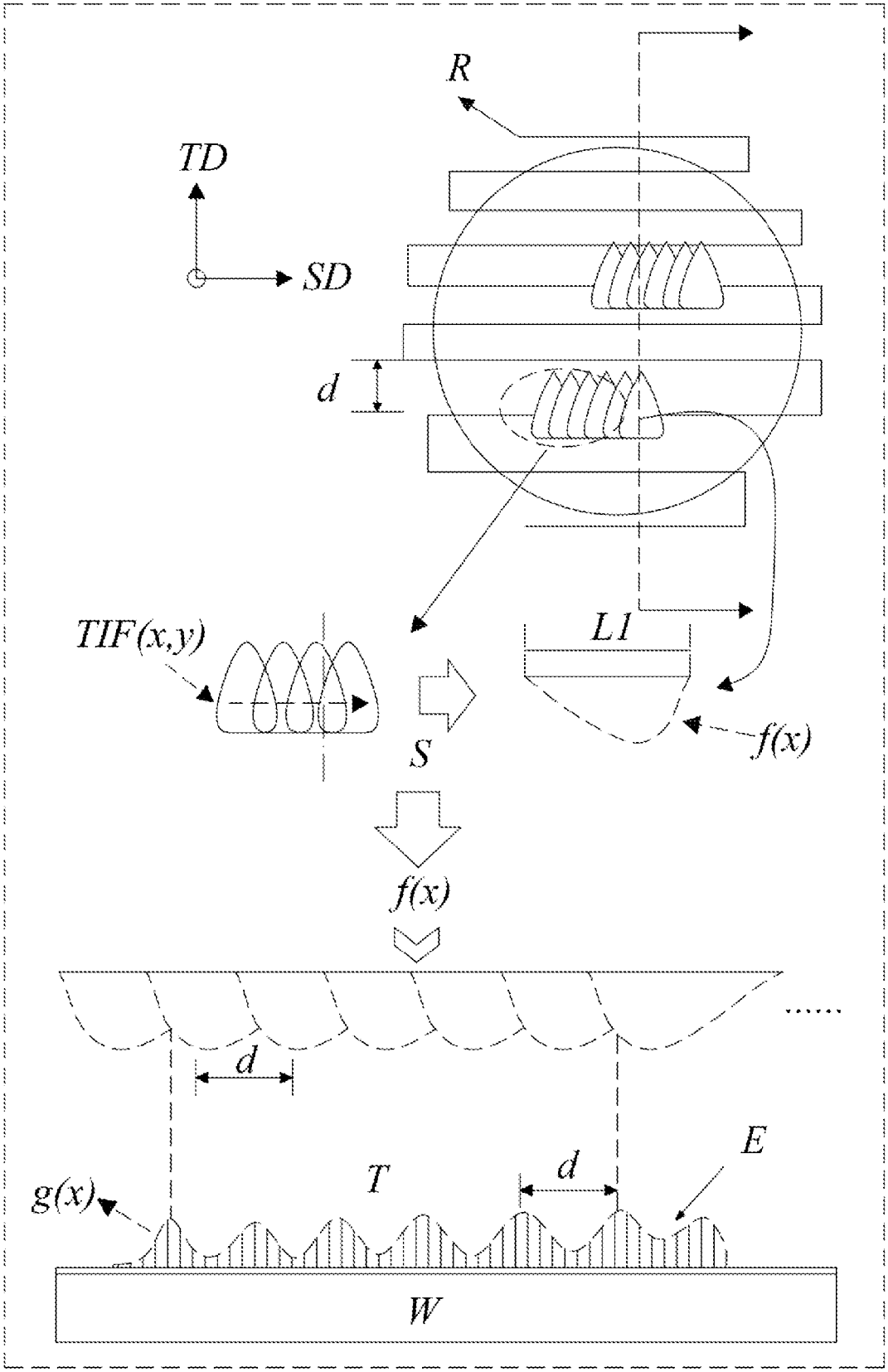
FIG. 1 is a schematic diagram illustrating a generation principle of mid-spatial-frequency errors in an existing magnetorheological polishing method in one embodiment.

To make the objectives, technical solutions, and advantages of the present disclosure clearer, the present disclosure is further described in detail below with reference to the drawings and embodiments. It should be understood that the specific embodiments described herein are merely used to explain the present disclosure, rather than to limit the present disclosure. All other embodiments obtained by a person of ordinary skill in the art based on the embodiments of the present disclosure without creative efforts shall fall within the protection scope of the present disclosure.

It should be noted that all the directional indications (such as upper, lower, left, right, front, back, etc.) in the embodiments of the present disclosure are merely used to explain a relative position relationship, motion situations, and the like of the components in a specific posture. If the specific posture changes, the directivity indication also changes accordingly.

Moreover, the terms such as "first", "second", and the like described in the present disclosure are used herein only for the purpose of description and are not intended to indicate or imply relative importance, or implicitly indicate the number of the indicated technical features. Therefore, features defined by "first" and "second" may explicitly or implicitly include at least one of the features. In the description of the present disclosure, "multiple groups" means at least two groups, such as two or three groups, unless otherwise clearly and specifically limited.

In the present disclosure, unless otherwise expressly specified and limited, the terms "connection" and "fixing" should be understood in a broad sense. For example, "fixing" can be a fixed connection, a detachable connection, or an integrated connection; it can be a mechanical connection or an electrical connection; it can be a direct connection or an indirect connection through an intermediate medium, and it can be a communication within two elements or an interaction relationship between two elements, unless otherwise expressly defined. Those of ordinary skill in the art may understand specific meanings of the above terms in the present application based on specific situations.

Furthermore, the technical solutions between the various embodiments of the present disclosure may be combined with each other, but must be on the basis that the combination thereof can be implemented by a person of ordinary skill in the art. In case of a contradiction with the combination of the technical solutions or a failure to implement the combination, it should be considered that the combination of the technical solutions does not exist, and is not within the protection scope of the present disclosure.

The present disclosure provides a spiral magnetorheological polishing method for mid-spatial-frequency error control. In an embodiment, the method includes: scanning along a polishing path by using a magnetorheological polishing method, and removing a material in a spiral manner with a polishing tool to achieve spiral magnetorheological polishing of a workpiece.

In this embodiment, an angle between a scanning direction and a workpiece material removal direction is changed in real time during scanning, to alter a spatial posture of a tool influence function on a polishing surface in a spiral manner, thereby reducing mid-spatial-frequency errors. Specifically, at the start of scanning and each time a scan line changes, a random angle is given to the polishing tool, and the angle between the scanning direction and the workpiece material removal direction is changed in real time; the spatial posture of the tool influence function on the polishing surface is altered in real time in a spiral manner with the polishing tool, so that one-dimensional profiles superimposed by the tool influence function each time on a cut line that is randomly selected on the polishing surface and perpendicular to a raster scanning path are all different, effectively reducing mid-spatial-frequency errors.

A material removal process is expressed as follows:

$$R(x, y) = \sum_{i=1}^{n}\sum_{j=1}^{m} TIF(x, y, t_{ij}) \times T(x, y) \neq TIF(x, y) * L(x, y); \quad \text{Formula 1}$$

where R(x,y) is a total material removal amount of a spiral tool influence function on the polishing surface, i=1, 2, . . . , n is the number of processing points in the scanning direction, j=1, 2, . . . , m is the number of line changes in the scanning (namely, the number of one-dimensional profiles superimposed), TIF(x,y,$t_{ij}$) is a spiral time-varying tool influence function, T(x,y) is a dwell time of the polishing tool at each point on a trajectory, TIF(x,y) is a tool influence function per unit time, * denotes convolution, and L(x,y) is a path function combined with the dwell time.

After the spiral magnetorheological polishing is completed, a frequency spectrum of surface texture in a line change direction is obtained:

$$G(f) = \sum_{j=1}^{m} \frac{p_j}{a_j} \cdot F(f(a_j x)) \cdot (\cos(2\pi f \cdot jd) - i' \sin(2\pi f \cdot jd))$$

where G(f) is the frequency spectrum of the surface texture in the line change direction after the spiral magnetorheological polishing is completed; i' is an imaginary unit; j=1, 2, . . . , m is the number of line changes in raster scanning; $p_j$ is an efficiency variation factor when the number of line changes is j; $a_j$ is a length variation factor when the number of line changes is j; when f=1/d, a real part of the frequency spectrum reaches a maximum value; F(f($a_j$x)) is a frequency spectrum of one-dimensional profiles superimposed by the tool influence function; f is a corresponding frequency on the frequency spectrum of the one-dimensional profiles, and d is a processing line spacing.

Preferably, the random angle given to the polishing tool is within a preset range to ensure the stability of the polishing tool.

Further preferably, the angle between the scanning direction and the workpiece material removal direction is changed in real time at a uniform speed, to further ensure the stability of the polishing tool and the dynamic performance of the machine tool, making the process easier to operate and implement.

In another embodiment, the method further includes: during scanning, randomly changing a processing line spacing (i.e., line change spacing) in real time to further achieve reduction (i.e., suppression) of mid-frequency ripple errors.

The scanning strategy employs raster scanning processing; when the scanning strategy employs raster scanning processing, the processing line spacing is a raster scanning spacing.

It should be noted that magnetorheological polishing is existing technology and will not be elaborated further here. The workpiece can be an optical element. The polishing tool can be a polishing wheel.

In the present disclosure, the magnetorheological polishing employs a unique shear polishing method that combines fluid dynamic pressure with magnetization pressure, where its tool influence function has a D-shaped structure rather than a rotationally symmetric structure. Therefore, the spatial posture of the tool influence function on the polishing surface can be changed through simple rotational operations. When the spatial posture of the tool influence function on the polishing surface changes continuously, the convolution kernel (tool influence function) in formula (1) becomes time-varying, and the removal method is no longer based on the convolution principle. Thus, it can fundamentally reduce the introduction of mid-spatial-frequency errors, especially mid-frequency ripple errors. Additionally, by allowing the processing line spacing d to vary randomly within a certain range and performing spiral rotation of the non-rotationally symmetric tool influence function unique to magnetorheological polishing during the processing, the combination of the two methods can better suppress mid-spatial-frequency errors fundamentally, especially mid-frequency ripple errors.

The foregoing spiral magnetorheological polishing method for mid-spatial-frequency error control overcomes the shortcomings of existing magnetorheological polishing methods, that is, mid-frequency ripple errors are produced easily, leading to a significant increase in mid-spatial-frequency errors. By using a controllable spiral tool influence function, it reduces mid-spatial-frequency errors, especially mid-frequency ripple errors. A random line spacing is set, that is, a random-line-spacing magnetorheological polishing method is designed, complementing the controllable spiral tool influence function. In other words, the spiral magnetorheological polishing method is combined with the random-line-spacing magnetorheological polishing method, achieving the mechanistic elimination of mid-frequency ripple errors, thereby reducing mid-spatial-frequency errors on the surface.

In a specific embodiment, taking the raster scanning path as an example, the generation of mid-frequency ripple errors on the workpiece surface under different methods is analyzed.

FIG. 1 is a schematic diagram illustrating the generation principle of mid-spatial-frequency errors in the existing magnetorheological polishing method, where W represents a workpiece, T represents a ripple period, E represents a mid-frequency ripple error, R represents a raster scanning path, d represents a processing line spacing, TD represents a line change direction (i.e., feed direction), SD represents a scanning direction, S represents superposition, L1 represents a length of a one-dimensional profile superimposed by the tool influence function along a selected line perpendicular to the raster scanning path, and g(x) represents a profile shape cut by a dashed section from a polished workpiece surface. The material removal in sub-aperture polishing can be described in a convolution form:

$$R(x, y)' = TIF(x, y) * L(x, y);$$

where R(x,y)' represents a total material removal amount of an existing tool influence function on the polishing surface, TIF(x,y) represents the tool influence function per unit time, and L(x,y) represents a path function combined with the dwell time.

The tool influence function TIF(x,y) superimposes the one-dimensional profile f(x) cut by the dashed line in the scanning direction, and both the tool influence function and the processing line spacing are fixed. Ultimately, the frequency spectrum of the surface texture obtained after the existing magnetorheological polishing is:

$$G(f)' = \sum_{j=1}^{m} F(f) \cdot (\cos(2\pi f \cdot jd) - i' \sin(2\pi f \cdot jd));$$

where G(f)' represents the frequency spectrum of the surface texture after the existing magnetorheological polishing, i' represents an imaginary unit, j=1, 2, . . . , m represents the number of line changes in the scanning, F(f) is a frequency spectrum of f, f is corresponding frequency on the frequency spectrum, and d is a processing line spacing (specifically, the raster scanning spacing here).

From the analysis of the above two equations, regardless of the value of j, when f=1/d is at its maximum, the real part of the frequency spectrum reaches a maximum value of 1, with a phase of 0. Therefore, under the raster scanning path of the existing magnetorheological polishing method, there are peaks at the harmonic frequencies, and as j increases, large peaks are formed through superposition, ultimately resulting in periodic convolution residual errors (i.e., periodic mid-frequency ripple errors), strongly correlated to the path, on the profile shape g(x) cut by the dashed section from the workpiece surface.

Figure 2:
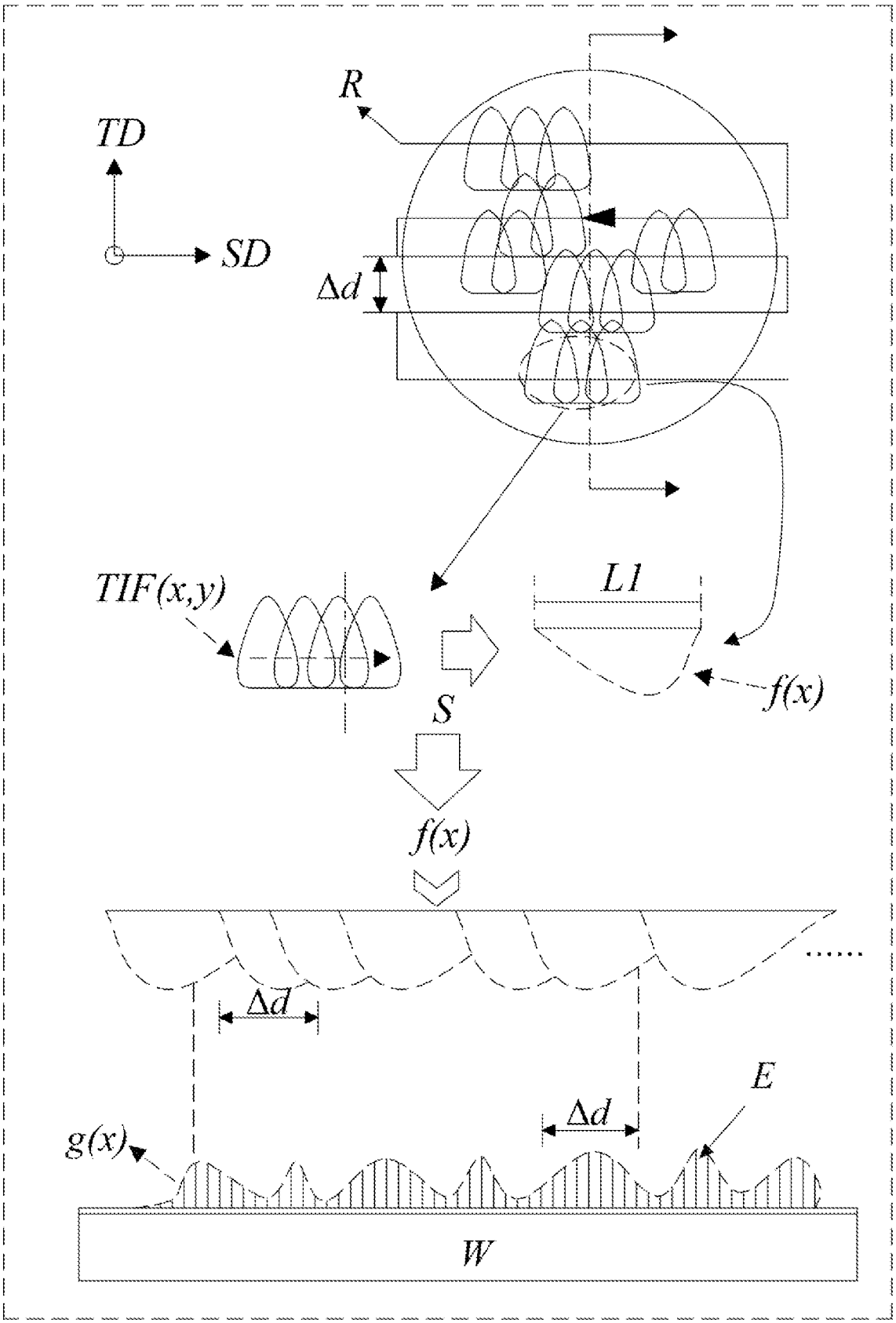
FIG. 2 is a schematic diagram illustrating a generation principle of mid-spatial-frequency errors in a random-line-spacing magnetorheological polishing method in one embodiment.

FIG. 2 is a schematic diagram illustrating the generation principle of mid-spatial-frequency errors in the random-line-spacing magnetorheological polishing method, where Δd is a random processing line spacing. The tool influence function HF(x,y) superimposes a one-dimensional profile f(x) cut by the dashed section in the scanning direction, which is no different from the raster scanning of the existing magnetorheological polishing method. By adopting a strategy of random line spacing, the profile shape g(x) cut by the dashed section from the polished workpiece surface, i.e., the shape of the processed workpiece surface, changes due to the variation in the processing line spacing (specifically, the raster scanning spacing here). Ultimately, the frequency spectrum of the surface texture obtained after the random-line-spacing magnetorheological polishing is:

$$G(f)'' = \sum_{j=1}^{m} F(f) \cdot (\cos(2\pi f d_j) - i' \sin(2\pi f d_j));$$

where G(f)" is the frequency spectrum of the surface texture after the random-line-spacing magnetorheological polishing, i' is an imaginary unit, j=1, 2, . . . , m is the number of line changes in the scanning, and $d_j$ is the raster scanning spacing when the number of line changes is j.

From the analysis of the above equation, when $f=1/d_j$, the real part of the frequency spectrum reaches a maximum value of 1, with a phase of 0. However, since the value of $d_j$ is random and does not increase with j, under the random-line-spacing raster scanning path, periodic peaks will not be generated, effectively suppressing mid-frequency ripple errors. However, this method will form irregular small peaks in the mid-spatial-frequency range, appearing as irregular "spikes" on the spectrum.

Figure 3:
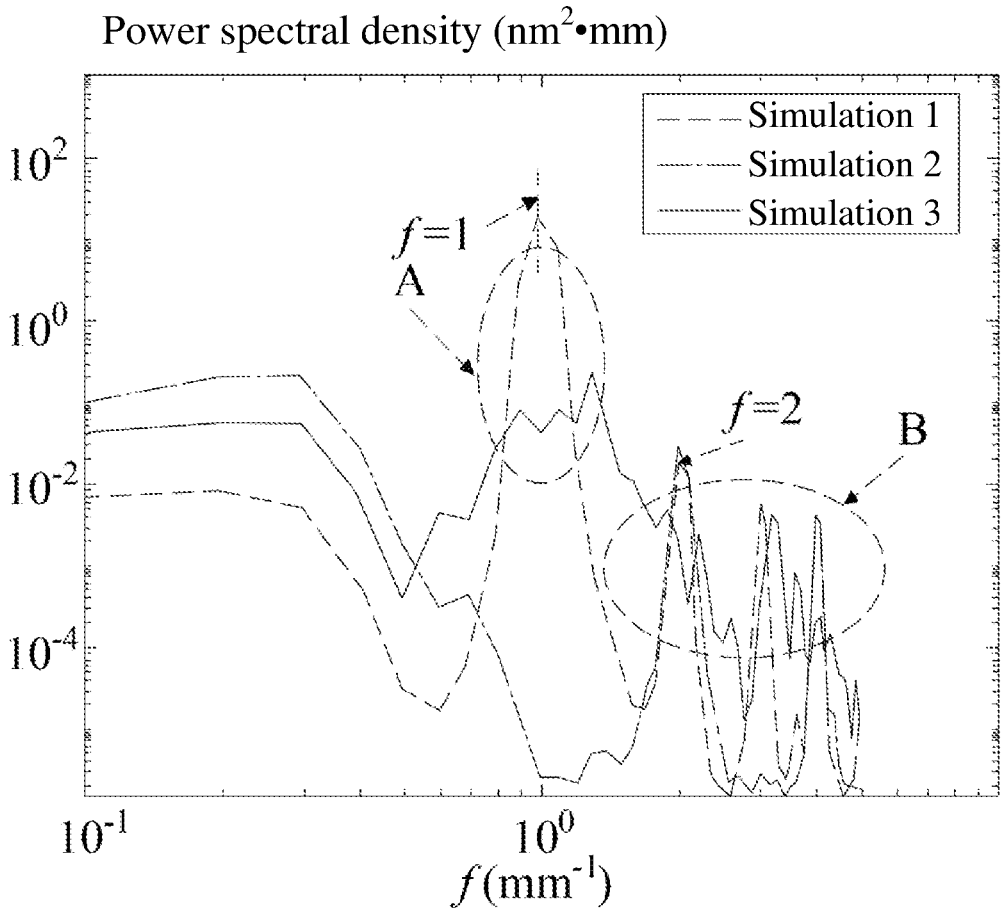
FIG. 3 is a diagram showing simulation power spectral density results of a random-line-spacing magnetorheological polishing method in one embodiment.

FIG. 3 is a diagram showing simulation power spectral density results of the random-line-spacing magnetorheological polishing method. The simulation results indicate that when the existing magnetorheological polishing method is used, mid-frequency ripple errors are introduced on the surface under both raster scanning spacings of 1 mm and 0.5 mm. When the random-line-spacing magnetorheological polishing method is used, a power spectral density (PSD) curve does not exhibit significant periodic peaks in either the spatial period of 1 $mm^{-1-1}$ or 2 $mm^{-1-1}$, and the surface shape results also do not show periodic structures. The periodic mid-frequency ripple errors generated by the original fixed line spacing in region A are significantly suppressed, while region B shows multiple irregular small peaks. This is consistent with the theoretical analysis and validates the effectiveness of the theoretical analysis.

Figure 4:
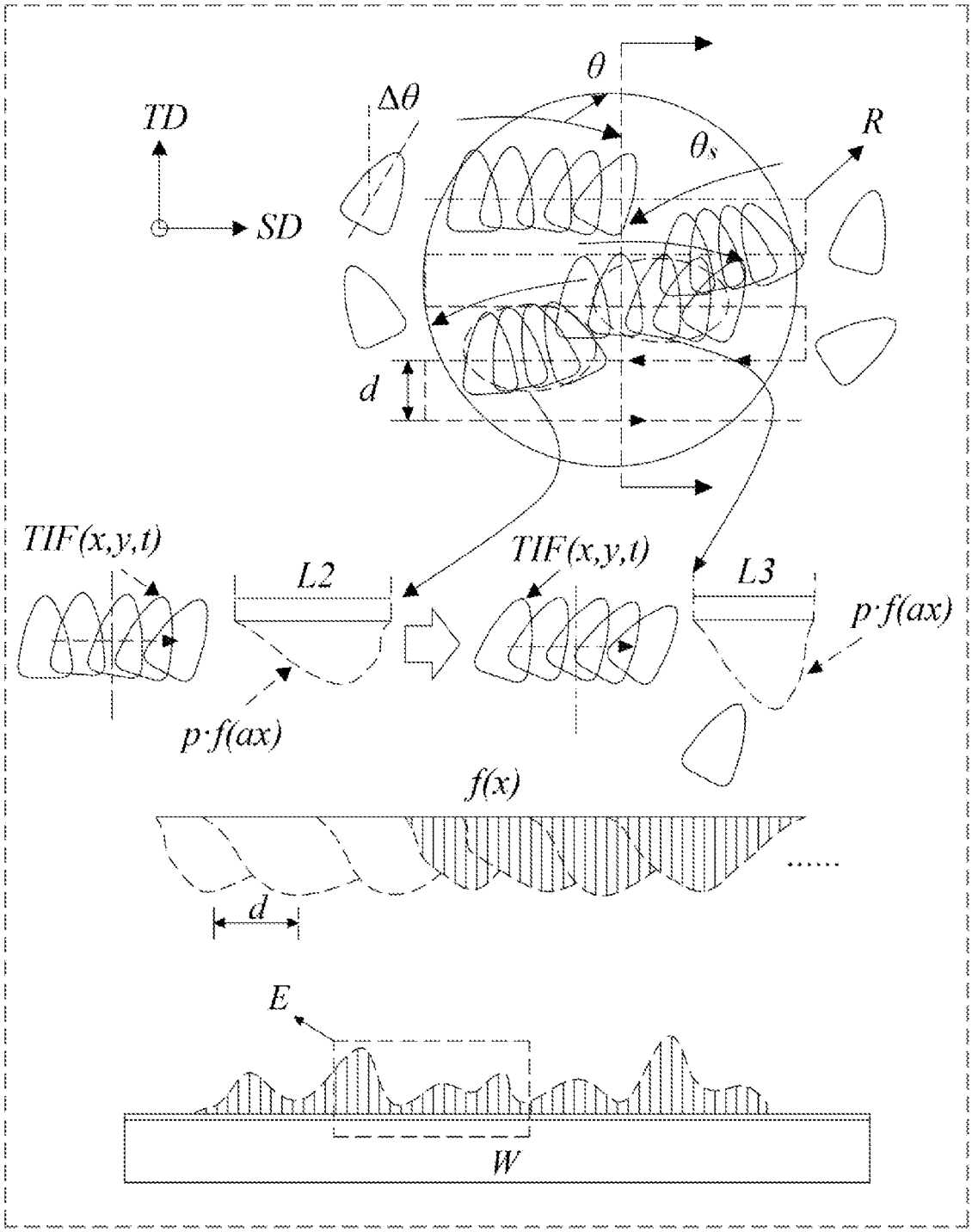
FIG. 4 is a schematic diagram illustrating a generation principle of mid-spatial-frequency errors in a spiral magnetorheological polishing method in one embodiment.

FIG. 4 is a schematic diagram illustrating the generation principle of mid-spatial-frequency errors in the spiral magnetorheological polishing method, where L2 and L3 are the lengths of one-dimensional profiles superimposed by the spiral tool influence function along a selected line perpendicular to the raster scanning path at different initial angles, θ is a spiral angle, Δθ is a random spiral angle, and $\theta_S$ is a step value of the spiral angle. The tool influence function TIF(x,y) superimposes a one-dimensional profile f(x) cut by the dashed section in the scanning direction. Compared to scanning with the fixed tool influence function, after a spiral approach is adopted for the tool influence function at different positions, that is, after the strategy of random spiral angles is adopted, the one-dimensional shape along the line change direction will undergo stretching, and both its width and peak removal efficiency will change. At this time, the one-dimensional shape of the tool influence function relative to the fixed tool influence function becomes p·f(ax), where a is a length variation factor and p is an efficiency variation factor. Therefore, the surface shape g(x) after polishing in the line change direction is:

$$g(x) = p \cdot \sum_{j=1}^{m} f(ax - jd).$$

Finally, the frequency spectrum of the surface texture in the line change direction obtained after the spiral magnetorheological polishing is:

$$G(f) = \sum_{j=1}^{m} \frac{p_j}{a_j} \cdot F(f(a_j x)) \cdot (\cos(2\pi f \cdot jd) - i' \sin(2\pi f \cdot jd))$$

From the analysis of the above equation, when f=1/d, the real part of the frequency spectrum reaches a maximum value, with a phase of 0. However, the value of $a_j$ changes over time, causing the spectrum of F(f(ax)) to stretch. During the superposition summation process as j changes, peak values of the original spectrum become misaligned, thereby weakening the peaks of the periodic ripples. The maximum value of the spectrum also varies with $a_j$, further weakening the periodicity of the ripples. Additionally, since the spiral method of the tool influence function is similar to "erasing," it can effectively smooth out the "spike" errors generated on the surface. However, this method still has a periodic fixed processing line spacing. Therefore, this method cannot completely eliminate mid-frequency ripple errors (at this point, it is not the ripple errors generated by the convolution effect), but can only suppress the amplitude of the ripples.

Figure 5:
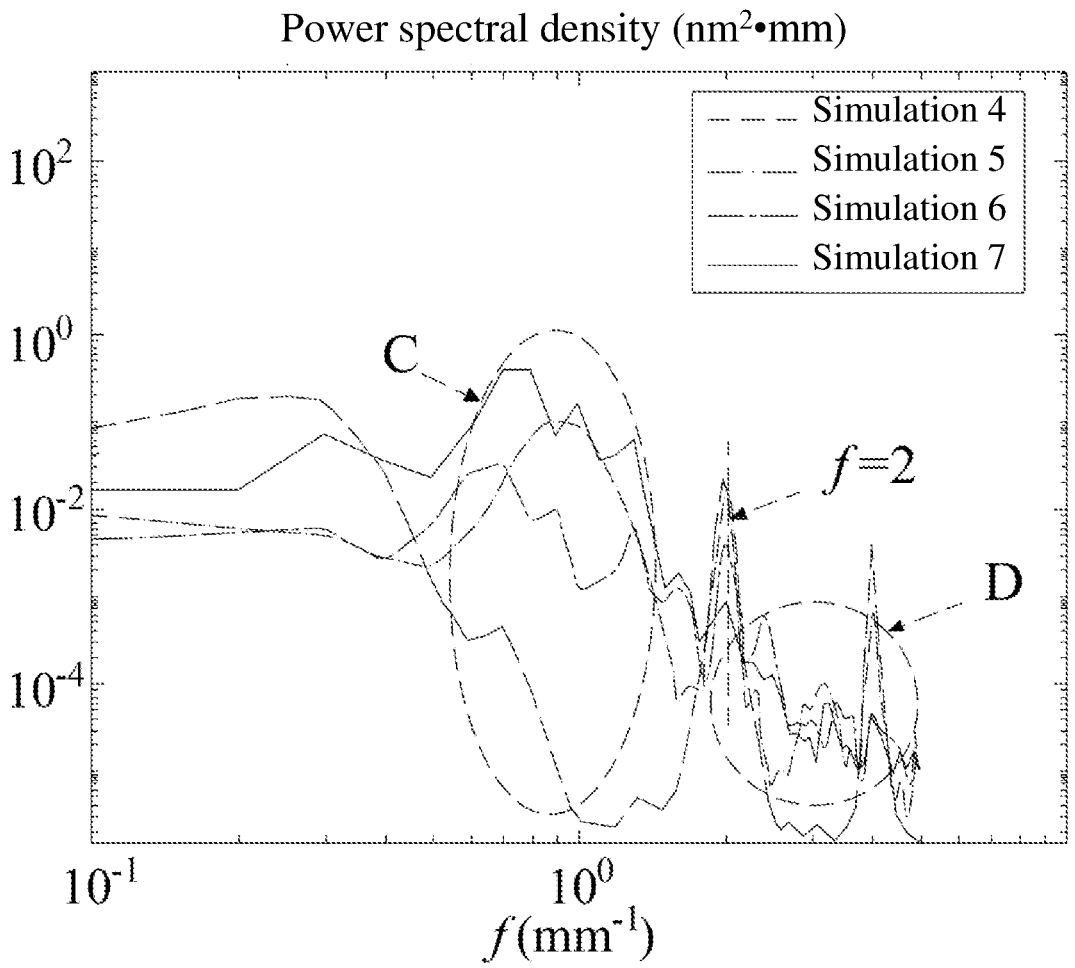
FIG. 5 is a diagram showing simulation power spectral density results of a spiral magnetorheological polishing method in one embodiment.

FIG. 5 is a diagram showing simulation power spectral density results of the spiral magnetorheological polishing method. When the raster scanning spacing is 0.5 mm, as the spiral angle increases, the original regular ripples are effectively erased, and the mid-spatial-frequency root mean square (RMS) error is well suppressed. However, when the spiral angle increases further, the mid-spatial-frequency RMS error will deteriorate again. This is because the spiral tool influence function smoothes the mid-frequency ripple errors, and once the mid-frequency ripple errors are well smoothed, increasing the spiral angle again will introduce errors from the spiral process. The peaks in region D are well smoothed; therefore, the strategy of random spiral angles cannot completely eliminate periodic ripples but can homogenize the errors across various frequency bands. Region C indicates that the spiral magnetorheological polishing method will increase the mid-spatial-frequency errors in the frequency band boxed in region C.

Preferably, by combining the random-line-spacing magnetorheological polishing method, which eliminates periodic mid-frequency ripple errors from the root, with the spiral magnetorheological polishing method, which has the ability to weaken ripple structures at various frequencies and smooth out "spike" errors, a new mid-spatial-frequency error suppression strategy is formed, referred to as the controllable spiral magnetorheological polishing method.

Figure 6:
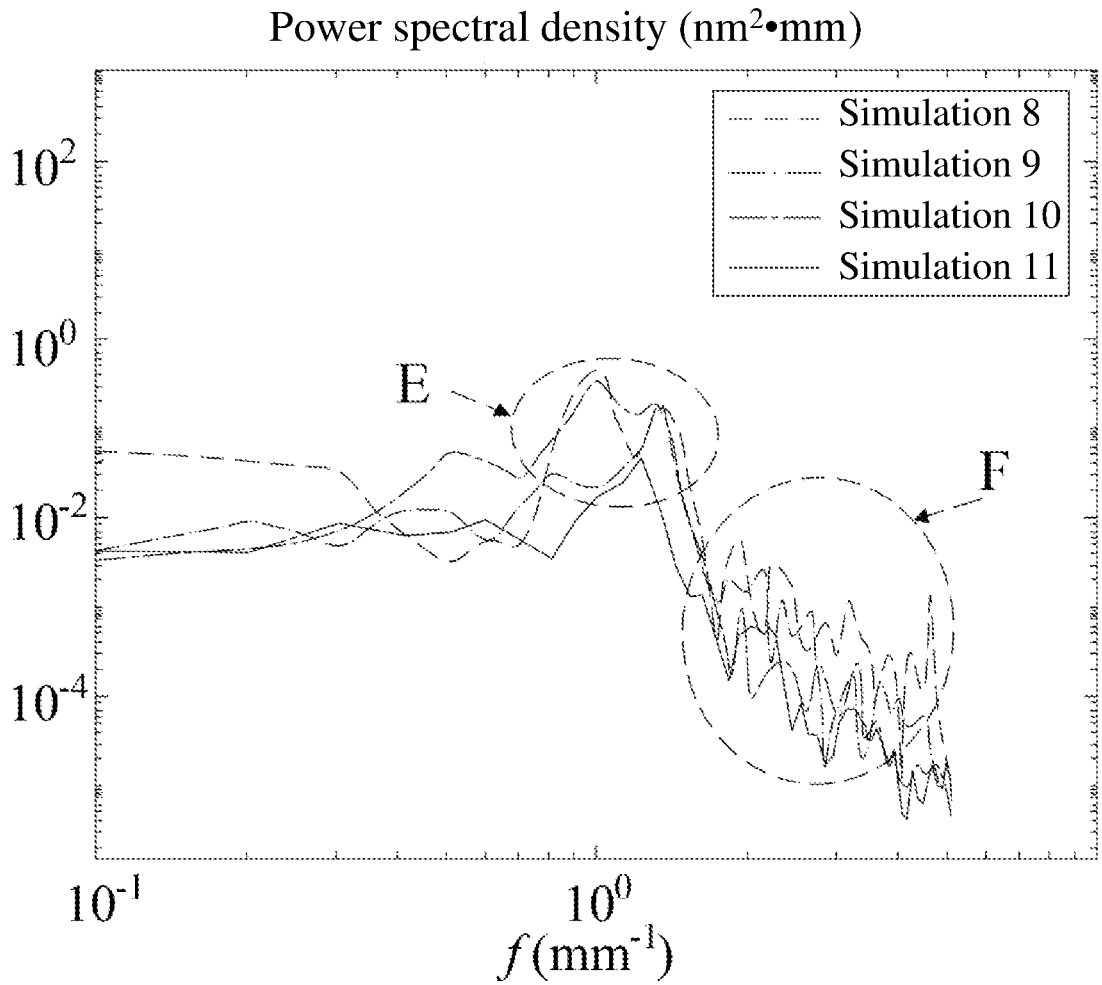
FIG. 6 is a diagram showing simulation power spectral density results of a controllable spiral magnetorheological polishing method in one embodiment.

FIG. 6 is a diagram showing simulation power spectral density results of the controllable spiral magnetorheological polishing method. It can be seen that the PSD curve does not have characteristic peaks. As the spiral angle increases, the mid-spatial-frequency RMS error is continuously smoothed, and the ripple structure of the surface shape results is "dispersed." Mid-spatial-frequency errors are effectively suppressed, and mid-spatial-frequency errors on the surface are smoothed. From region E, it can be seen that as the spiral angle increases, the values of the mid-spatial-frequency PSD curve continuously decrease, effectively suppressing mid-spatial-frequency errors. From region F, it can be seen that the combination of spiral magnetorheological polishing and random-line-spacing magnetorheological polishing can effectively suppress the "spikes" in other frequency bands caused by random line spacing.

In summary, the controllable spiral magnetorheological polishing method proposed in the present disclosure combines the advantages of the random-line-spacing magnetorheological polishing method and the spiral magnetorheological polishing method, effectively eliminating mid-frequency ripple errors and mitigating errors across the entire mid-spatial-frequency band. It can overcome the defects of existing magnetorheological methods that produce mid-spatial-frequency errors and achieves good practicality.

The technical characteristics of the above embodiments can be employed in arbitrary combinations. To provide a concise description of these embodiments, all possible combinations of all the technical characteristics of the above embodiments may not be described; however, these combinations of the technical characteristics should be construed as falling within the scope defined by the specification as long as no contradiction occurs.

The above embodiments are merely illustrative of several implementations of the present disclosure, and the description thereof is more specific and detailed, but is not to be construed as a limitation to the patentable scope of the present disclosure. It should be noted that those of ordinary skill in the art can further make variations and improvements without departing from the conception of the present disclosure. These variations and improvements all fall within the protection scope of the present disclosure. Therefore, the protection scope of the present disclosure shall be subject to the appended claims.

What is claimed is:

1. A spiral magnetorheological polishing method for mid-spatial-frequency error control, comprising:

causing a polishing tool to scan along a raster scanning path line by line through using a magnetorheological polishing technology, and removing workpiece materials by changing an angle between a scanning direction and a workpiece material removal direction at each of processing points in the raster scanning path;

wherein changing the angle between the scanning direction and the workpiece material removal direction at each of the processing points in the raster scanning path comprises:

at a start of scanning and upon switching to a next scan line, generating respective random values for the angle such that respective random values corresponding to respective scan lines are different, and for each scan line of the raster scanning path, changing, from a corresponding random value, the angle at each of the processing points of the scan line such that a first one-dimensional profile obtained by superimposing a spiral time-varying tool influence function at respective processing points in a first scan line of the raster scanning path is different from a second one-dimensional profile obtained by superimposing the spiral time-varying tool influence function at respective processing points in each of other scan lines of the raster scanning path.

2. The spiral magnetorheological polishing method for mid-spatial-frequency error control according to claim 1, wherein the removing workpiece materials comprises a material removal process, and wherein the material removal process comprises:

$$R(x, y) = \sum_{i=1}^{n}\sum_{j=1}^{m} TIF(x, y, t_{ij}) \times T(x, y) \neq TIF(x, y) * L(x, y);$$

wherein R(x,y) is a total material removal amount of the spiral time-varying tool influence function on a polishing surface, i=1, 2, . . . , n is a serial number of processing points in each scan line, j=1, 2, . . . m is a serial number of each scan line in the scanning, TIF(x, y,$t_{ij}$) is the spiral time-varying tool influence function, T(x,y) is a dwell time of the polishing tool at each processing point on a trajectory, TIF(x,y) is a tool influence function per unit time, * denotes convolution, and L(x,y) is a path function combined with the dwell time.

3. The spiral magnetorheological polishing method for mid-spatial-frequency error control according to claim 1, wherein a frequency spectrum of a surface texture in a scan line change direction obtained after spiral polishing comprises:

$$G(f) = \sum_{j=1}^{m} \frac{p_j}{a_j} \cdot F(f(a_j x)) \cdot (\cos(2\pi f \cdot jd) - i' \sin(2\pi f \cdot jd))$$

wherein G(f) is the frequency spectrum of the surface texture in the scan line change direction after the spiral magnetorheological polishing is completed; i' is an imaginary unit; j=1, 2, . . . , m is a serial number of each scan line in the scanning; $p_j$ is an efficiency variation factor at a j-th scan line; $a_j$ is a length variation factor at the j-th scan line; F(f($a_j$x)) is a frequency spectrum of a one-dimensional profile obtained by superimposing the spiral time-varying tool influence function at respective processing points in the j-th scan line, and when f=1/d, a real part of the frequency spectrum of the one-dimensional profile reaches a maximum value; f is a corresponding frequency on the frequency spectrum of the one-dimensional profile, and d is a spacing among the scan lines.

4. The spiral magnetorheological polishing method for mid-spatial-frequency error control according to claim 1, further comprising: during the scanning, randomly changing spacings among the scan lines to further achieve suppression of mid-frequency ripple errors.

5. The spiral magnetorheological polishing method for mid-spatial-frequency error control according to claim 1, wherein the random values for the angle are within a preset range.

6. The spiral magnetorheological polishing method for mid-spatial-frequency error control according to claim 5, wherein the removing workpiece materials comprises a material removal process, and wherein the material removal process comprises:

$$R(x, y) = \sum_{i=1}^{n}\sum_{j=1}^{m} TIF(x, y, t_{ij}) \times T(x, y) \neq TIF(x, y) * L(x, y);$$

wherein R(x,y) is a total material removal amount of the spiral time-varying tool influence function on a polishing surface, i=1, 2, . . . , n is a serial number of processing points in each scan line, j=1, 2, . . . , m is a serial number of each scan line in the scanning, TIF(x, y,$t_{ij}$) is the spiral time-varying tool influence function, T(x,y) is a dwell time of the polishing tool at each processing point on a trajectory, TIF(x,y) is a tool influence function per unit time, * denotes convolution, and L(x,y) is a path function combined with the dwell time.

7. The spiral magnetorheological polishing method for mid-spatial-frequency error control according to claim 5, wherein a frequency spectrum of a surface texture in a scan line change direction obtained after spiral polishing comprises:

$$G(f) = \sum_{j=1}^{m} \frac{p_j}{a_j} \cdot F(f(a_j x)) \cdot (\cos(2\pi f \cdot jd) - i' \sin(2\pi f \cdot jd))$$

wherein G(f) is the frequency spectrum of the surface texture in the scan line change direction after the spiral magnetorheological polishing is completed; i' is an imaginary unit; j=1, 2, . . . , m is a serial number of each scan line in the scanning; $p_j$ is an efficiency variation factor at a j-th scan line; $a_j$ is a length variation factor at the j-th scan line; F(f($a_j$x)) is a frequency spectrum of a one-dimensional profile obtained by superimposing the spiral time-varying tool influence function at respective processing points in the j-th scan line, and when f=1/1d, a real part of the frequency spectrum the one-dimensional profile reaches a maximum value; f is a corresponding frequency on the frequency spectrum of the one-dimensional profile, and d is a spacing among the scan lines.

8. The spiral magnetorheological polishing method for mid-spatial-frequency error control according to claim 5, further comprising: during the scanning, randomly changing spacings among the scan lines to further achieve suppression of mid-frequency ripple errors.

9. The spiral magnetorheological polishing method for mid-spatial-frequency error control according to claim 5, wherein for each scan line of the raster scanning path, changing, from the corresponding random value, the angle between the scanning direction and the workpiece material removal direction at each of the processing points is performed at a uniform speed.

10. The spiral magnetorheological polishing method for mid-spatial-frequency error control according to claim 9, wherein the removing workpiece materials comprises a material removal process, and wherein the material removal process comprises:

$$R(x, y) = \sum_{i=1}^{n}\sum_{j=1}^{m} TIF(x, y, t_{ij}) \times T(x, y) \neq TIF(x, y) * L(x, y);$$

wherein R(x,y) is a total material removal amount of the spiral time-varying tool influence function on a polishing surface, i=1, 2, . . . , n is a serial number of processing points in each scan line, j=1, 2, . . . , m is a serial number of each scan line in the scanning, TIF(x, y,$t_{ij}$) is the spiral time-varying tool influence function, T(x,y) is a dwell time of the polishing tool at each processing point on a trajectory, TIF(x,y) is a tool influence function per unit time, * denotes convolution, and L(x,y) is a path function combined with the dwell time.

11. The spiral magnetorheological polishing method for mid-spatial-frequency error control according to claim 9, wherein a frequency spectrum of a surface texture in a scan line change direction obtained after spiral polishing comprises:

$$G(f) = \sum_{j=1}^{m} \frac{p_j}{a_j} \cdot F(f(a_j x)) \cdot (\cos(2\pi f \cdot jd) - i' \sin(2\pi f \cdot jd))$$

wherein G(f) is the frequency spectrum of the surface texture in the scan line change direction after the spiral magnetorheological polishing is completed; i' is an imaginary unit; j=1, 2, . . . , m is a serial number of each scan line in the scanning; $p_j$ is an efficiency variation factor at a j-th scan line; $a_j$ is a length variation factor at the j-th scan line; F(f($a_j$x)) is a frequency spectrum of a one-dimensional profile obtained by superimposing the spiral time-varying tool influence function at respective processing points in the j-th scan line, and when f=1/1d, a real part of the frequency spectrum of the one-dimensional profile reaches a maximum value; f is a corresponding frequency on the frequency spectrum of the one-dimensional profile, and d is a spacing among the scan lines.

12. The spiral magnetorheological polishing method for mid-spatial-frequency error control according to claim 9, further comprising: during the scanning, randomly changing spacings among the scan lines to further achieve suppression of mid-frequency ripple errors.

* * * * *